US006113564A

United States Patent [19]

McGuire

[11] Patent Number: 6,113,564

[45] Date of Patent: Sep. 5, 2000

[54] PORTABLE LUMBAR TRACTION DEVICE

[76] Inventor: Leif McGuire, 1135 N. Chapel Hill, Clovis, Calif. 93611

[21] Appl. No.: 09/136,259

[22] Filed: Aug. 18, 1998

[51] Int. Cl.[7] ..... A61H 1/02

[52] U.S. Cl. ..... 602/32; 602/36; 606/241; 482/95; 482/131; 482/904; 482/907

[58] Field of Search ..... 482/95, 131, 143, 482/144, 904, 907; 602/32–36; 606/241

[56] References Cited

U.S. PATENT DOCUMENTS

| | | | |
|---|---|---|---|
| 2,938,695 | 5/1960 | Ciampa | 482/904 |
| 3,547,111 | 12/1970 | Viel . | |
| 4,362,151 | 12/1982 | Cottrell . | |
| 4,419,990 | 12/1983 | Forster . | |
| 4,492,224 | 1/1985 | Singleton . | |
| 4,531,514 | 7/1985 | McDonald . | |
| 4,602,619 | 7/1986 | Wolf . | |
| 4,627,423 | 12/1986 | Kampner . | |
| 5,209,712 | 5/1993 | Ferri | 482/131 |
| 5,254,065 | 10/1993 | Pollock | 482/904 |
| 5,387,186 | 2/1995 | Edland . | |

OTHER PUBLICATIONS

Rajala Therapy Sales, Inc. 1997–1998 Product and Service Guide.

*Primary Examiner*—John Mulcahy
*Assistant Examiner*—Victor Hwang
*Attorney, Agent, or Firm*—Mark D. Miller

[57] ABSTRACT

Disclosed is a portable apparatus for providing lumbar traction in the home or while traveling which is used in conjunction with a door or gate. The apparatus includes an anchoring device which fits over the top of an ordinary door. The anchor is connected to an adjustable support strap which is attached to a junction box. An adjustable rope passing over a pulley in the junction box is provided with a grip at one end, and a pelvic traction belt at the other end. A locking mechanism is provided on the junction box to set the adjustable rope attached to the traction belt in a desired position. The device is attached over a door, and the user puts on the traction belt and lies down on the floor with knees bent, the soles of both feet flat against the door. By pulling the grip of the rope, the traction belt can be raised to a desired position for traction, and then locked in place. After an appropriate period of traction, the user disengages the lock, and lowers the traction belt. During use, a knee strap may be used to hold the legs together thereby allowing the user to relax.

10 Claims, 5 Drawing Sheets

PORTABLE LUMBAR TRACTION DEVICE

BACKGROUND OF THE INVENTION

1. Field of the Invention

The present invention relates to traction devices for the spine, and in particular to a new method and portable apparatus for providing lumbar traction that can be used in the home.

2. Description of the Prior Art

It is well known that vertebral disorders in the human back can be treated by placing the spine and vertebrae under tension. Such tension or traction serves to distract, or pull apart, the intervertebral discs and apophyseal joints of the spine thereby removing pressure from nerve roots that may be pinched while keeping the apophyseal joints and ligaments at rest. It has been determined that the optimal position for a patient undergoing spinal traction is flat on his or her back, with the legs elevated.

Numerous traction devices have been developed for applying traction to the human spine. Many of these devices utilize a platform, stool or other support structure to elevate the knees and lower legs of the patient while lying on his back. See, e.g., U.S. Pat. Nos. 4,362,151, 4,419,990 and 4,602,619. Such elevating structures are usually placed near the foot of a bed, and are typically used in conjunction with a traction imparting device that is either attached to the elevating structure itself or to a frame attached to the bed. While such devices place the spine in an appropriate position for traction, they tend to be bulky, and are difficult to set up and take down. As a result, they are not portable and are better adapted for use in a hospital setting rather than in a home.

The traction devices found in U.S. Pat. Nos. 4,531,514 and 5,387,186 utilize a trapeze or T-bar instead of an elevating stool to support the knees of the user. These devices can also be cumbersome to use, making them less portable and less desirable for home use. In addition, when used for the extended periods required for proper traction, these devices may be uncomfortable to use, and may cause an interruption of normal blood circulation to the legs below the knees. It is therefore desirable to provide a simple, portable and effective lumbar traction device for use in the home that can be easily set up and taken down for use while traveling.

SUMMARY OF THE INVENTION

The present invention accomplishes these objectives by providing a portable traction device for home or travel use which may be attached to a door. The device of the present invention includes an anchoring device which fits over the top of an ordinary door. The anchor is connected to an adjustable support strap which is attached to a junction box. An adjustable rope passing over a pulley in the junction box connects a pelvic traction belt at one end to a rope handle at the opposite end. The junction box contains a locking mechanism (e.g. a "V" groove) for setting the adjustable rope attached to the traction belt in a desired position.

In use, a single-pull pelvic traction belt is attached to one end of a rope which is passed over a pulley in a junction box. A handle is provided on the opposite end of the rope. A lock is provided in the junction box in the vicinity of the pulley. An anchoring device is fitted over the top of a closable door so that a strap attached thereto hangs down freely, and the door is then closed. The strap is then attached to the junction box. The user then steps into the traction belt such that the rope attached thereto passes from behind the user up between the legs. The user then removes shoes and socks and lies down on the floor, with knees bent so that the bottoms of both feet rest against the door. Use of a mat or rug and a small pillow is recommended for comfort.

By pulling the handle of the rope, the traction belt can be raised to a desired position for traction. Once this position is reached, the rope is allowed to fall into the locking mechanism of the junction box to hold the traction belt rope in position. After an appropriate period of traction, the user may disengage by pulling on the traction rope while lifting the hips to disengage the lock. The legs may then be lowered and the traction belt removed.

In an alternative embodiment, a knee support belt is provided to hold the thighs or knees of the user together during extended periods of traction. After the user has locked the device in the desired traction position, one knee is brought towards the chest and a strap placed behind the knee. The foot is then replaced against the door. This process is repeated using the same strap with the other knee. The strap is then engaged to prevent the knees and legs from falling to either side, allowing them to be relaxed during traction. When completed, the strap is first removed from the legs and the lock is disengaged. The legs may then be lowered and the traction belt removed.

In yet another embodiment, additional pulleys and rope wraps may be employed, if desired, to provide an additional mechanical advantage as in a block and tackle.

It is therefore an important object of the present invention to provide a simple apparatus for providing lumbar traction that can be used in conjunction with an ordinary door or gate.

It is also an important object of the present invention to provide a highly portable apparatus for providing lumbar traction for use in conjunction with an ordinary door or gate that employs simple and easily stored component parts.

It is also an object of the present invention to provide an inexpensive, portable and simple apparatus for providing lumbar traction in the home which only requires the presence of an ordinary door or gate.

Additional objects of the invention will be apparent from the detailed descriptions and the claims herein.

DETAILED DESCRIPTION OF THE PREFERRED EMBODIMENT

Figure 1:
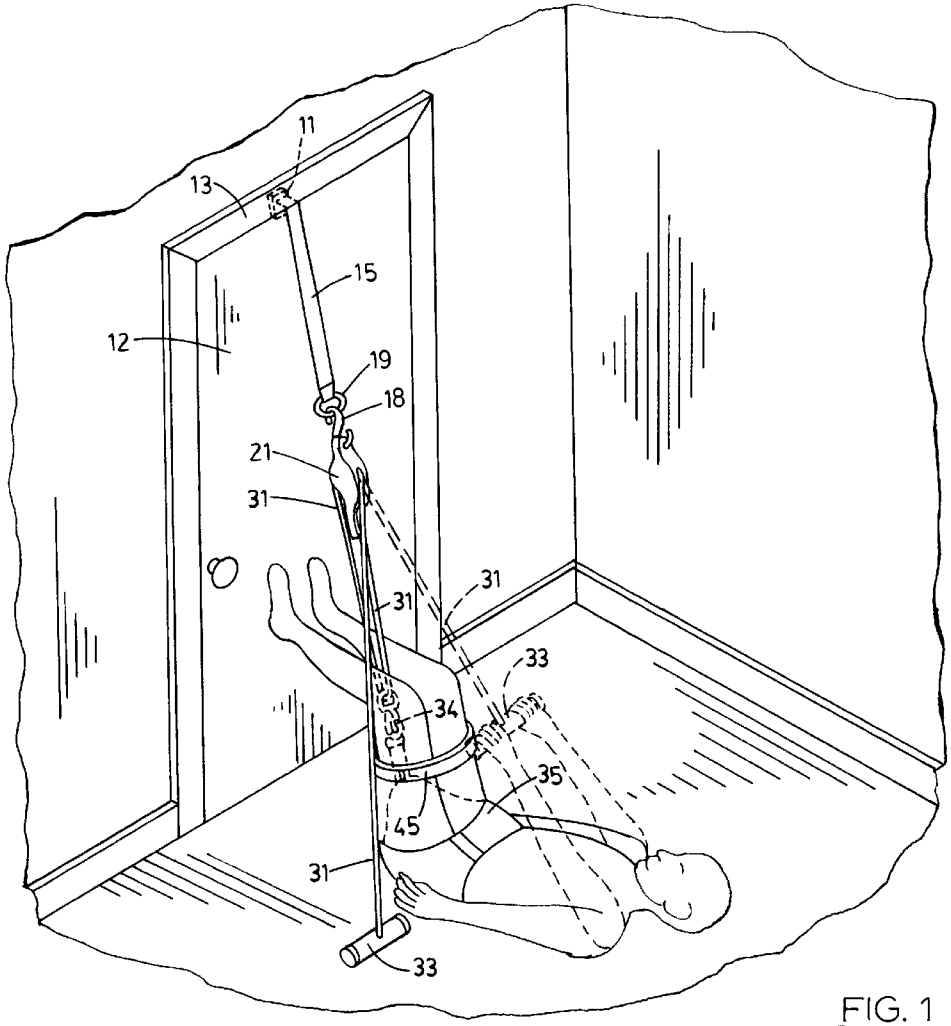
FIG. 1 is a perspective view of the traction device of the present invention engaged by a user. The phantom lines show the user adjusting the belt with the rope.
Figure 3:
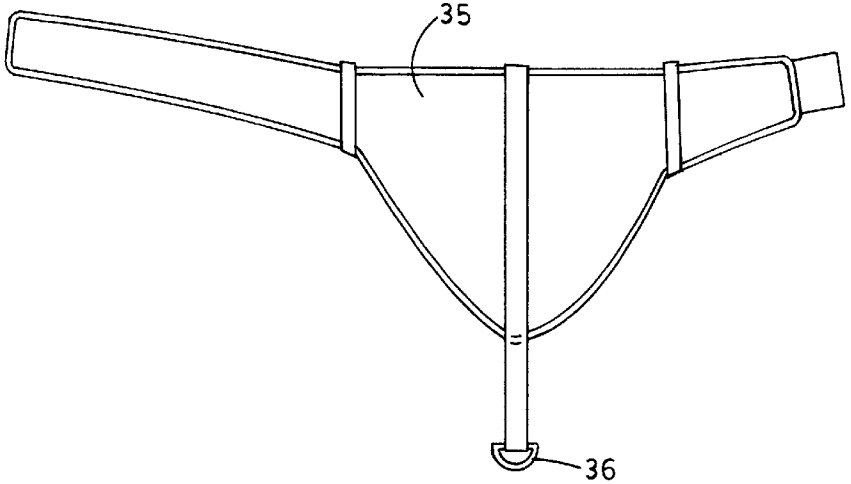
FIG. 3 is a close up view of the single pull pelvic traction belt used in the present invention.
Figure 2:
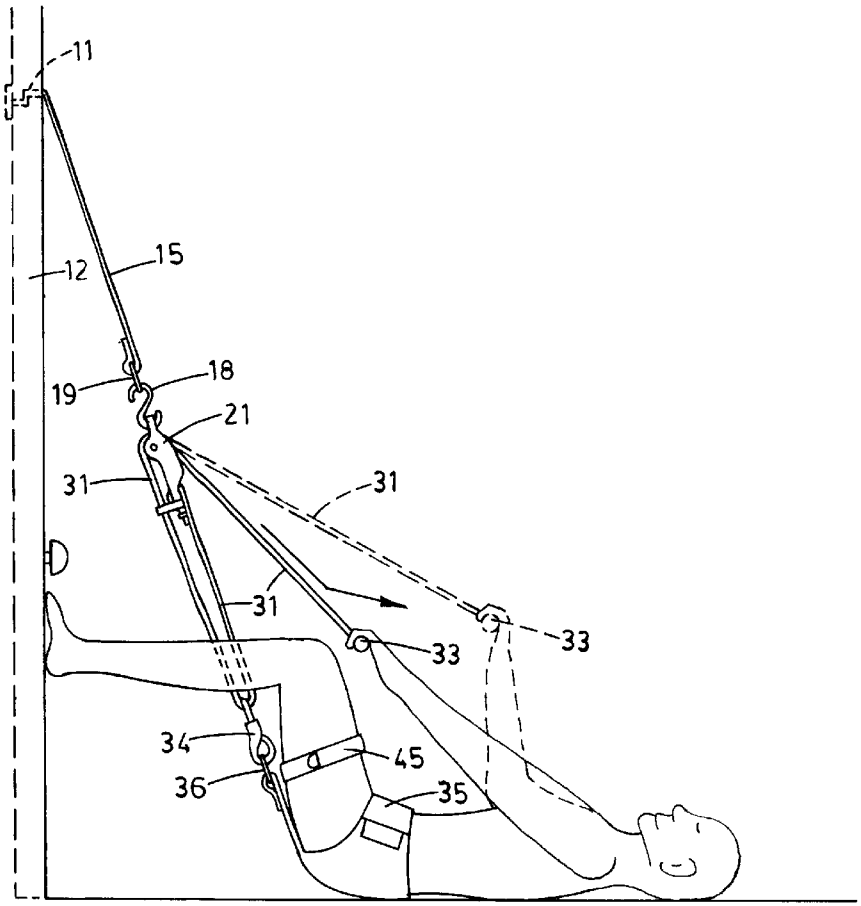
FIG. 2 is a side view of the present invention in use. The phantom lines show the user adjusting the belt with the rope.
Figure 6:
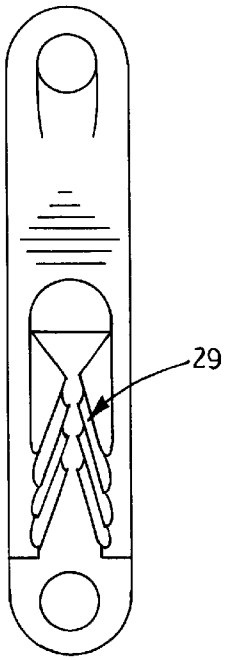
FIG. 6 is an end view of the junction box along line 6—6 of FIG. 4.
Figure 5:
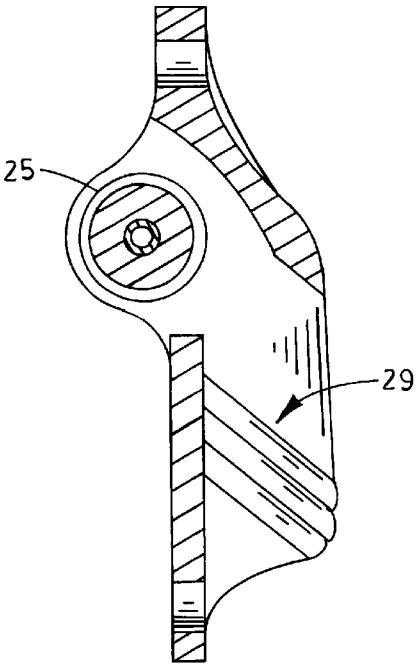
FIG. 5 is a sectional side view of the junction box along line 5—5 of FIG. 4.
Figure 4:
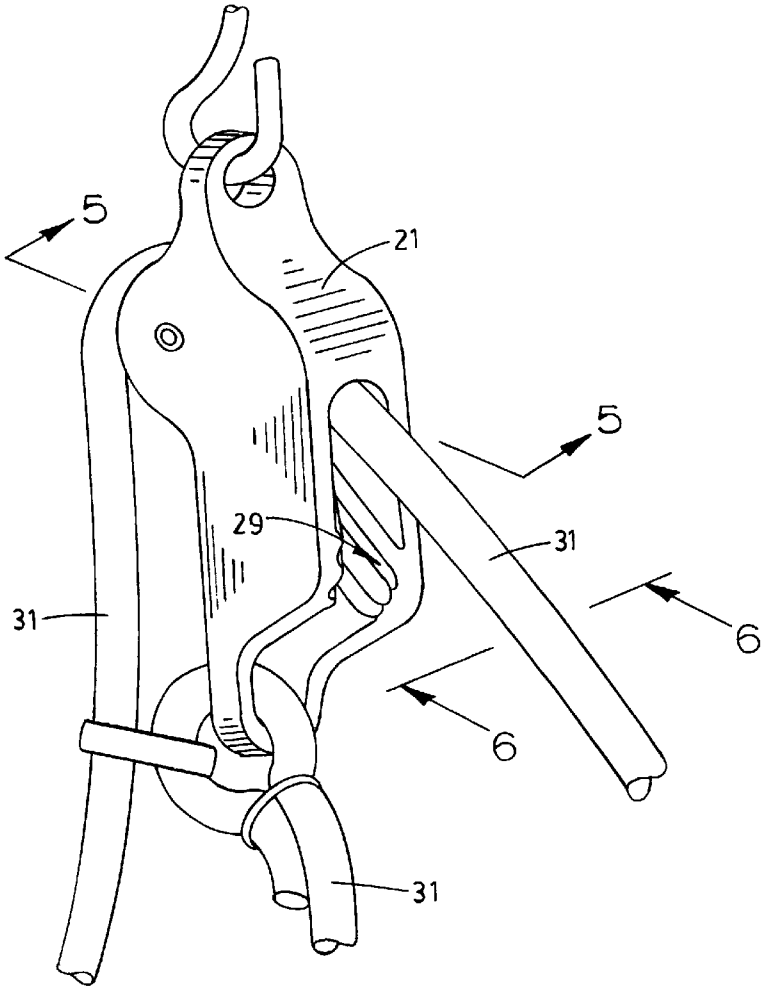
FIG. 4 is a perspective close up view of the junction box of the present invention.
Figure 7:
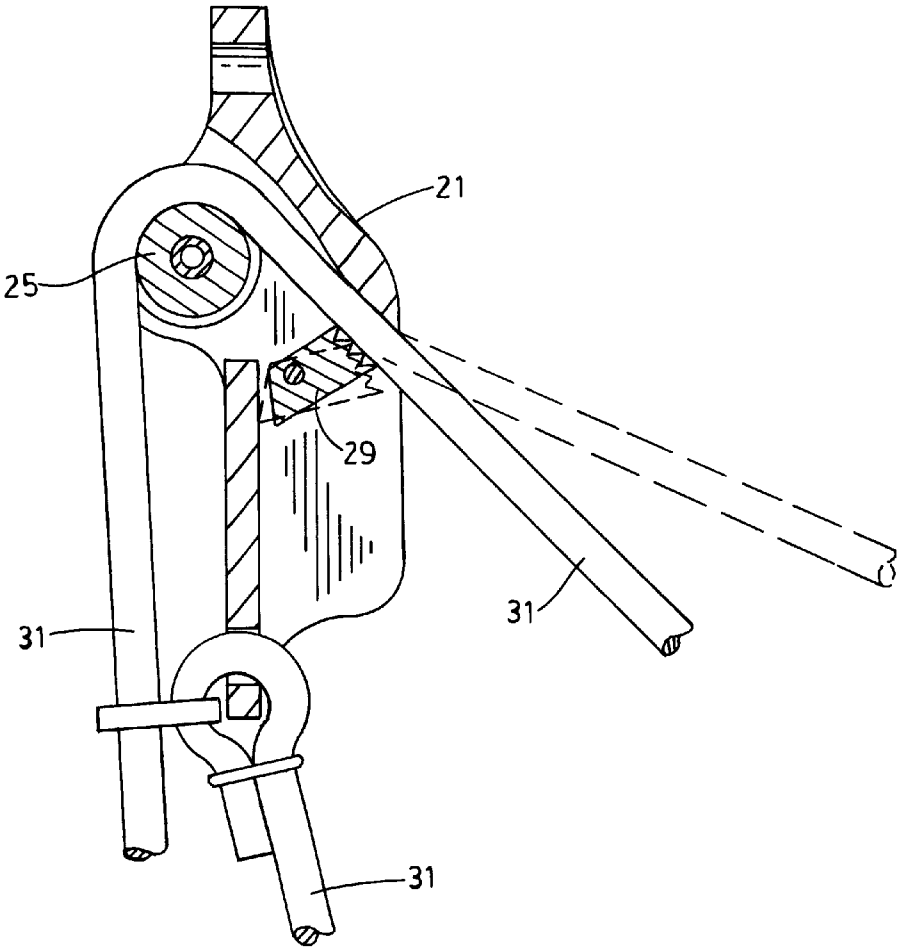
FIG. 7 is a sectional side view of an alternative embodiment of the junction box locking mechanism of FIG. 5. The phantom lines show adjustment of the rope to release.

Referring to the drawings wherein like reference characters designate like or corresponding parts throughout the several views, and referring particularly to FIGS. 1 and 2 it is seen that the invention includes an anchor 11 for attachment over the top of a door 12. A support strap 15 is attached to anchor 11. Anchor 11 may be in any form which allows it to be placed over the door while open, and to work in conjunction with the door when closed to provide frictional resistance for strap 15. Anchor 11 may be the form of an L-shaped piece which fits over the top and one edge of the door; or it may simply be a piece that is too large to be pulled through the thin gap between the top of the door 12 and the door frame or transom 13 (as shown in FIG. 1). In the embodiment of FIG. 2, anchor 11 has a staggered L-shape allowing for use with different sized doors.

A junction box 21 is provided at the opposite end of strap 15 from anchor 11. Box 21 may be attached to strap 15 using any suitable connection mechanism such as a swivel, or the hook 18 and eyelet 19 shown in FIGS. 1 and 2. A movable pulley 25 is provided inside junction box 21 over which rope 31 is passed. A single pull pelvic traction belt 35 (described more fully below) is provided at one end of rope 31, and a handle or grip 33 is provided at the opposite end of rope 31. Belt 35 may be moved up and down by imparting or releasing force on rope 31 using grip 33 to hold rope 31 away from the body of the user so that rope 31 passes freely over pulley 25.

A locking mechanism 29 is provided in junction box 21 adjacent to rope 31. Lock 29 may be in any appropriate form such as a pivotally mounted member having teeth at one end, a flange, or a "V" shaped groove such that imparting downward force on grip 33 of rope 31 engages rope 31 against lock 29 thereby holding it in place. In the locked position, traction belt 35 is held in position and supported by the door 12 through strap 15 and rope 31. Lock 29 may be disengaged by imparting upward force on rope 31 using grip 33. Once lock 29 is disengaged, rope 31 may again freely pass over pulley 25 allowing traction belt 35 to be raised or lowered, as desired.

Figure 8:
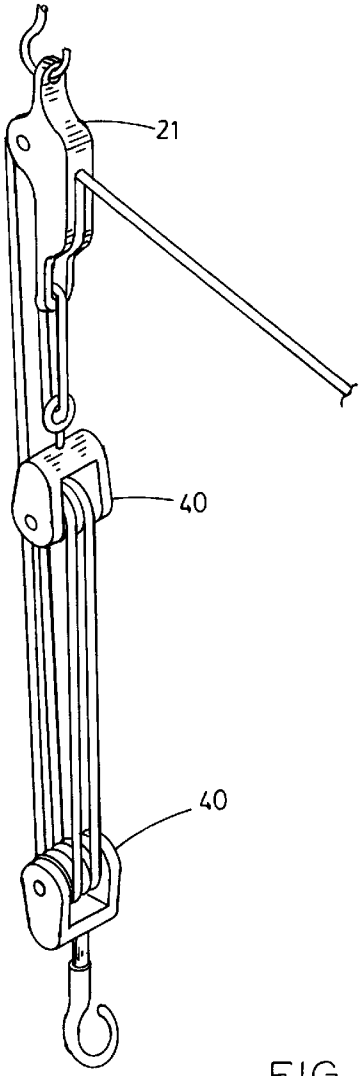
FIG. 8 is a perspective view of an alternative embodiment of the present invention.

In the preferred embodiment shown in FIGS. 1 and 2, the opposite end of rope 31 is attached directly to junction box 21, and traction belt 35 is slidably attached along rope 31 between the direct attachment to box 21 and pulley 25. This embodiment provides a slight mechanical advantage. Additional pulleys and rope wraps may be employed, if desired, to provide an additional mechanical advantage as in a block and tackle 40 (See FIG. 8). A swivel, hook and eyelet, or other appropriately disengageable attachment mechanism 34 is used to attach eyelet 36 of traction belt 35 to or over rope 31.

In the preferred embodiment, a knee or thigh belt 45 is provided to hold the knees or upper legs of the user together. This prevents the upper legs from falling to the side, and allows the user to relax them during traction.

To use the invention, the user first opens a door 12 and places the anchor 11 over the top of the door. Door 12 is closed such that strap 15 hangs down therefrom and cannot be pulled loose. Junction box 21 containing rope 31 is then attached to the bottom of strap 15. Rope 31 is attached to or through eyelet 36 on traction belt 35. The user steps into belt 35 and engages it around the waist such that eyelet 36 and rope 31 come up from the user's back side between the legs. The user then removes shoes and socks, or puts on shoes having highly frictional soles (e.g. rubber) and lies down on his or her back with rope 31 extending up from between the legs. The user then bends the knees and moves such that the soles of the feet (or frictional shoes) are flat against door 12.

Lateral force is then imparted to rope 31 using handles 33 in order to raise belt 35. When belt 35 has been brought to a satisfactory position, lock 29 may be engaged by pulling down on rope 31. This holds belt 35 in place. For extended traction, in order to avoid the fatigue associated with the user holding his or her legs together for a long period of time, a knee or leg strap 45 may be placed around both legs at the knees to hold them together. This allows the user to relax until traction is discontinued. Lock 29 is disengaged by pulling up on rope 31 while lifting the hips upward, freeing belt 35. The user may then disengage the belt 35 and knee strap 45. The door 12 may then be opened to disengage the anchor 11. All of the ropes, handles, straps, swivels as well as the belt of the present invention may be easily wrapped into a compact package for storage or for travel.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A portable apparatus for providing lumbar traction comprising a support strap having an anchor at one end thereof for releasable attachment at the top of a door between said door and its frame, and a junction box at the opposite end of said strap, said box containing at least one rotatable pulley and a locking member adjacent thereto; a rope passing across said pulley adjacent to said member, said rope having a grip at one end thereof and a lumbar traction belt at the opposite end thereof for engagement around the waist of a user in a reclining position with the user's back on the floor, the bottoms of the feet of the user flat against the door, and the user's knees bent at an angle of about ninety degrees, said rope being releasably lockable against said member to hold said rope in place to provide support for said belt, and a thigh belt for releasable attachment around the thighs of the user for controlling external rotation of the hip joints during use.

2. The apparatus of claim 1 wherein one end of said rope is attached to said junction box and said traction belt is slidably positioned on said rope between said attachment and said pulley.

3. The apparatus of claim 2 wherein said anchor is a piece having a modified L-shape which fits over the top and one edge of the door.

4. The apparatus of claim 2 wherein said locking member is in the form of a V-shaped groove in said junction box adjacent to said pulley for releasably holding said rope in place.

5. The apparatus of claim 2 wherein said locking member is pivotally mounted in said junction box adjacent to said rope having teeth at one end for releasably holding said rope in place.

6. The apparatus of claim 1 wherein said anchor is too large to be pulled through the gap between the top of the door and the door frame.

7. The apparatus of claim 1 wherein a block & tackle is provided between said belt and said junction box.

8. A method for providing lumbar traction comprising the steps of:

a. placing a portable anchoring mechanism attached to a strap over the top of an open door;

b. closing said door such that said anchoring mechanism is engaged between said door and its frame, said strap being securely suspended therefrom;

c. engaging a lumbar traction belt having a rope slidably engaged therewith around the waist of a user, said rope extending across a pulley located in a junction box attached to the lower end of said strap, said rope terminating at a grip;

d. positioning the user on his back;

e. bending the knees of the user at about ninety degrees;

f. positioning the bottoms of the user's feet against said door;

g. passing said rope between the user's legs;

h. adjusting said rope using said grip until said belt is in a desired position on the user for lumbar traction;

i. releasably locking said rope in place to hold the desired position of said belt; and j. attaching a strap around the thighs of the user for controlling external rotation of the user's hip joints.

9. The method of claim 8 including the additional step of unlocking said rope after a desired period of time.

10. The method of claim 9 including the additional steps of opening said door, removing said anchoring mechanism from said door, disengaging said traction belt from the waist of the user, and compactly wrapping said parts together for storage.

* * * * *